US011049378B2

(12) United States Patent
Houde-Walter et al.

(10) Patent No.: US 11,049,378 B2
(45) **Date of Patent: *Jun. 29, 2021**

(54) DETERRENT DEVICE COMMUNICATION SYSTEM

(71) Applicant: LMD Applied Science, LLC, Rochester, NY (US)

(72) Inventors: Susan Houde-Walter, Rochester, NY (US); Craig M. Czajka, W. Henrietta, NY (US)

(73) Assignee: LMD Applied Science, LLC, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/551,149

(22) Filed: Aug. 26, 2019

(65) Prior Publication Data

US 2020/0058207 A1 Feb. 20, 2020

Related U.S. Application Data

(63) Continuation of application No. 15/858,041, filed on Dec. 29, 2017, now Pat. No. 10,395,497, which is a continuation of application No. 14/583,245, filed on Dec. 26, 2014, now Pat. No. 9,885,530.

(60) Provisional application No. 61/921,274, filed on Dec. 27, 2013.

(51) Int. Cl.

| | |
|---|---|
| ***G08B 15/00*** | (2006.01) |
| ***F41A 17/00*** | (2006.01) |
| ***F41A 17/02*** | (2006.01) |
| ***F41A 17/06*** | (2006.01) |
| *G08B 25/00* | (2006.01) |
| *G08B 25/01* | (2006.01) |

(52) U.S. Cl.

CPC ..... *G08B 15/001* (2013.01); *F41A 17/00* (2013.01); *F41A 17/02* (2013.01); *F41A 17/063* (2013.01); *G08B 25/009* (2013.01); *G08B 25/01* (2013.01)

(58) Field of Classification Search

CPC ..... G08B 25/01; G08B 25/016; G08B 25/10; G08B 15/001; G08B 15/01; G06P 3/0848; F41A 17/00; F41A 17/02; F41A 17/06; F41A 17/063; F41A 17/066; F41G 3/26

See application file for complete search history.

(56) References Cited

U.S. PATENT DOCUMENTS

| | | | |
|---|---|---|---|
| 4,934,086 | A | 6/1990 | Houde-Walter |
| 6,286,242 | B1 | 9/2001 | Klebes |
| 7,602,329 | B2 | 10/2009 | Manderville et al. |

(Continued)

FOREIGN PATENT DOCUMENTS

| | | |
|---|---|---|
| AU | WO9855817(A1) | 12/1998 |

OTHER PUBLICATIONS

Office Action for U.S. Appl. No. 14/583,245, dated Mar. 13, 2017, Houde-Walter, "Deterrent Device Communication System", 6 pages.

*Primary Examiner* — Van T Trieu
(74) *Attorney, Agent, or Firm* — Lee & Hayes, P.C.

(57) ABSTRACT

A deterrent device communication apparatus is linked to a deterrent device. When the deterrent device is in a ready state, the communication apparatus cooperates with an intermediate communication device to establish a communication path with an emergency response center through which the holder of the deterrent device can communicate.

23 Claims, 16 Drawing Sheets

(56) References Cited

U.S. PATENT DOCUMENTS

| | | | | |
|---|---|---|---|---|
| 8,312,660 | B1 | 11/2012 | Fujisaki | |
| 8,339,257 | B2 | 12/2012 | Cazanas et al. | |
| 9,224,096 | B2 * | 12/2015 | Oppenheimer | H04W 4/029 |
| 9,658,022 | B1 * | 5/2017 | Farrell | F41A 33/00 |
| 10,395,497 | B2 * | 8/2019 | Houde-Walter | G08B 25/01 |
| 2002/0170219 | A1 | 11/2002 | Martin | |
| 2003/0021188 | A1 | 1/2003 | Baranek et al. | |
| 2006/0042142 | A1 | 3/2006 | Sinha | |
| 2006/0050929 | A1 | 3/2006 | Rast et al. | |
| 2006/0242879 | A1 | 11/2006 | Schmitter | |
| 2007/0264616 | A1 | 11/2007 | Namgung | |
| 2011/0061280 | A1 | 3/2011 | Emde et al. | |
| 2011/0072703 | A1 | 3/2011 | Ferrarini et al. | |
| 2012/0062388 | A1 | 3/2012 | Wilson | |
| 2013/0236040 | A1 | 9/2013 | Crawford et al. | |
| 2014/0272806 | A1 | 9/2014 | Hunt | |

* cited by examiner

DETERRENT DEVICE COMMUNICATION SYSTEM

CROSS-REFERENCE TO RELATED APPLICATIONS

This application is a continuation of U.S. application Ser. No. 15/858,041, filed Dec. 29, 2017, now U.S. Pat. No. 10,395,497, which is a continuation of U.S. application Ser. No. 14/583,245, filed Dec. 26, 2014, now U.S. Pat. No. 9,885,530, which claims the benefit of U.S. Provisional Application No. 61/921,274, filed Dec. 27, 2013. The entire disclosures of the above applications are incorporated herein by reference.

FIELD OF THE INVENTION

The present invention relates to communication systems and devices and more particularly to communication devices and systems that can be used in cooperation with a deterrent device.

BACKGROUND OF THE INVENTION

The decision to use a deterrent device such as a firearm in a response to a home invasion is not a decision that is made lightly. Many homeowners would prefer to allow trained law enforcement professionals to address such situations. However, when confronted with the possibility of a home invasion it may be necessary to make a split second decision as to whether to reach for a firearm or to reach for a telephone. This gives a homeowner a difficult choice between arming to defend oneself and remaining disarmed and distracted while attempting to contact law enforcement officials.

It is known to equip firearms with gunshot detectors and notification systems that advise local authorities when the firearm is discharged. Examples of this include but are not limited to US Pat. Pub. No. 2006/0042142 entitled Gunshot Detector Notification System, U.S. Pat. No. 8,339,257 entitled Firearm and System for Notifying Firearm Discharge and US Pat. Pub. No. 2012/0062388 entitled Firearms Management System. However, such approaches merely notify authorities that firearm has been discharged and do not achieve the goal of preventing the need for the homeowner to discharge the weapon. Additionally, firearm interlock systems are known that prevent firearms from being used in certain areas or regions. For example, US Pat. Pub. No. 2002/0170219 entitled Dischargeable Hand Weapons Having Reduced Criminal Usefulness describes a firearm control system that limits the geographical area in which the firearm will discharge to an area where the firearm is kept for defense. However, this does nothing to assist the homeowner in the case of a home invasion.

Additionally, many of these systems require that a cellular telephone be integrated into the firearm. This creates difficulties in that incorporating such technologies into the firearm typically requires a significant alteration in weapon design, balance, handling and ultimately utility.

What is needed therefore is an integrated approach to home defense allowing a homeowner to seek help from law enforcement while maintaining an active and ready deterrent capability.

The challenge of maintaining a firearm or other deterrent device in a ready position during a home invasion while also attempting to communicate with police or other law enforcement authorities can be complicated when a homeowner chooses to retreat into a hiding place while waiting for seeking law enforcement help. In such circumstances, the dilemma of whether to focus on manipulating a deterrent device or a telephone can extend for a significant period of time.

Despite these challenges it can be critical for a homeowner to maintain communications with law enforcement personnel during a home invasion. For example, such communications can be important in helping to direct law enforcement personnel to particular portions of the home where the perpetrator may be found. Such communications can also be used to help ensure that law enforcement is aware of locations of the home where the homeowner or other family members may be found so as to lessen the risk that the homeowner or family members will be confused with the perpetrator and to lessen the risk that law enforcement will take actions that may endanger a homeowner or other family members.

Accordingly, what is needed is a new personal defense system that enables communication between a homeowner with law enforcement personnel while allowing the homeowner to maintain an active and ready defensive position.

BRIEF SUMMARY OF THE INVENTION

In one aspect, a deterrent device communication system is provided with deterrent device communication apparatus linked to the deterrent device for movement therewith and having an audio capture circuit, an audio output circuit, a transmitter of less than 100 mW power, a receiver; and a controller that determines when an activation sensor senses a condition indicating that the deterrent device is in a ready condition and that, after such determining causes the audio input circuit and the transmitter to cooperate to transmit wireless signals from which sounds sensed at the deterrent device can be reproduced and to cause the receiver and audio output circuit to generate sounds based upon wireless audio bearing signals received from the intermediate communication device. An intermediate communication device that detects the wireless signals transmitted by the deterrent device communication apparatus, and a control system that causes the intermediate communication device to open a communication path between the intermediate communication device and an emergency response center and uses the opened communication path to send signals to the emergency response center from which the emergency response center can reproduce the sounds sensed at the deterrent device.

The intermediate communication device further uses communication path to receive signals from which sounds sensed at the emergency response center can be reproduced and generates the wireless audio bearing signals.

DETAILED DESCRIPTION OF THE INVENTION

Figure 1:
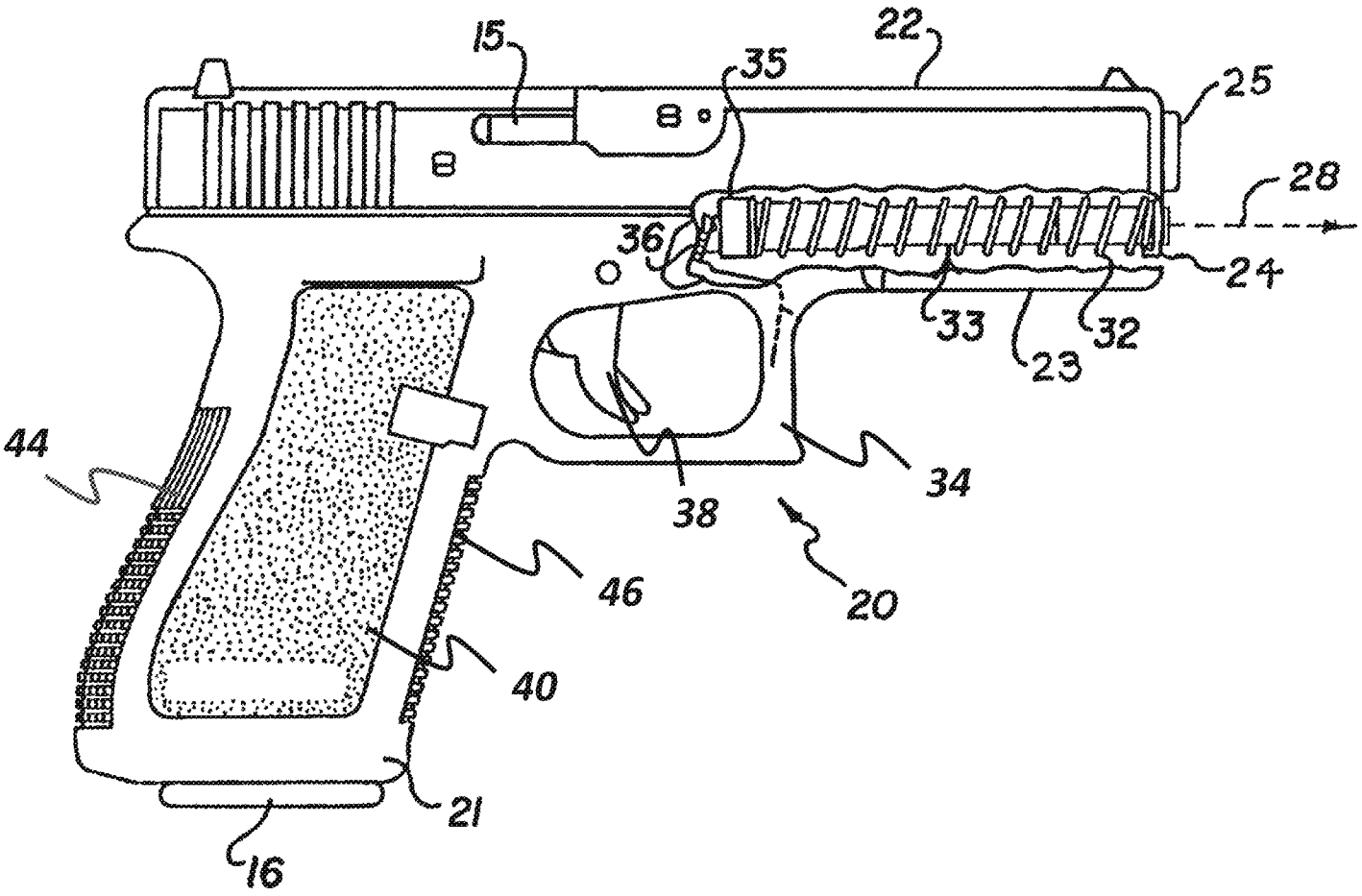
FIG. 1 PRIOR ART
FIG. 1 shows a side view of a deterrent device of the prior art.

FIG. 1 illustrates a first embodiment of a prior art deterrent device 20. As is illustrated in FIG. 1, in this embodiment, deterrent device 20 comprises a handheld firearm shown here as a representative semi-automatic pistol. In other embodiments, deterrent device 20 can be, but is not limited to, a rifle, shotgun, revolver or other form of firearm, a chemical irritant disperser, a non-lethal projectile launcher, or a directed energy weapon such as device that emits a sonic, optical or electrical discharge alone or in combination with a projectile that will cause a person confronted with such a homeowner wielding such a deterrent device 20 to be less likely to be aggressive.

In the embodiment of FIG. 1, deterrent device 20 is shown as a Glock 17/17L/18/19/20/21 and 22 manufactured by Glock, GmbH of Austria and the Sigma 9 mm 17/17L/18/22/24 manufactured by Smith & Wesson of Springfield, Mass. In this embodiment, deterrent device 20 has a pistol grip frame 21 that holds a magazine 16 that contains a number of rounds of ammunition. The ammunition is spring biased in a direction toward a reciprocating firing chamber 22 (also referred to as a slide). Cartridges from spent rounds are ejected through ejection slot 15 when the reciprocating chamber 22 moves to the left or backward under recoil action following discharge. A barrel 25 extending from the reciprocating chamber 22 is connected to the pistol grip frame 21 via a modified take-down latch 36.

Disposed beneath reciprocating chamber 22 is a recoil chamber 23. Within recoil chamber 23 is an optional laser sight 33 that emits a laser beam along an axis 28 and that in this embodiment also performs the functions of conventional recoil spring guide rod. A recoil spring 32, which surrounds laser sight 33, extends between an apertured projection 24 of reciprocating chamber 22 at one end of the recoil chamber 23 and an annular seat 35 of laser sight 33 at the other end of recoil chamber 23.

Figure 2:
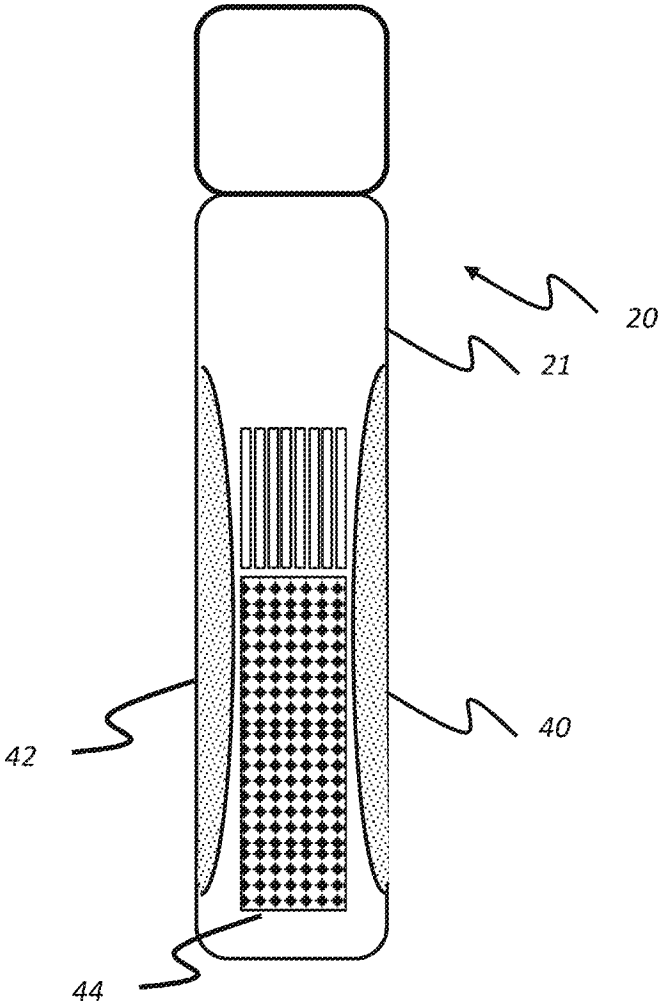
FIG. 2 PRIOR ART
FIG. 2 shows rear view of a deterrent device of the prior art.

FIG. 2 is a back view of the embodiment of deterrent device 20 of FIG. 1 showing various gripping surfaces. As is shown in FIGS. 1 and 2 deterrent device 20 has a first side grip 40 opposing a second side grip 42, and a rear grip surface 44 opposite a front grip surface 46. Conventionally, during gripping, a right handed user will wrap a thumb of the right hand around side grip 42 and a palm and fingers of the right hand will wrap against rear grip surface 44, and side grip 40 and onto front grip surface 46. For enhanced accuracy, many right handed users are trained to raise their left hand against deterrent device 20 so that a palm of the left hand cups magazine 16 and side grip surface 42. Firing of deterrent device 20 is accomplished by inserting a finger into trigger guard 34, and pulling trigger 38 toward rear grip surface 44. A threshold amount of pull force is required in order to draw trigger 38 to a position where deterrent device 20 discharges. The amount of pull force that is required is set at a level that is sufficient to avoid inadvertent discharge of deterrent device and is typically on the order of around one or more kilograms of pull force.

It will be appreciated from this that the maintenance of such a two-handed a grip precludes manipulating a communication device.

Grip surfaces 40, 42, 44 and 46 are conventionally at least partially provided with some form of roughening pattern such as, diamond, stripes, or pyramidal cut patterns illustrated in FIG. 2. These roughening patterns enhance the ability of a user to grip deterrent device 20 by providing increased friction between deterrent device 20 and the hand(s) of the user. Additionally, such roughening patterns provide channels into which substances that may be on the hand of the user can flow during gripping of deterrent device 20 so as to allow a clean contact between deterrent device 20 and at least a portion of the hand(s) of the user.

When deterrent device 20 is held in anticipation of use, the user will typically apply significant gripping force to ensure proper aiming of deterrent device 20, to prevent being disarmed, and in anticipation of any kickback or recoil that arises when deterrent device 20 is discharged. It is difficult to do this while also attempting to manipulate a communication device such as a cellular phone.

Figure 3:
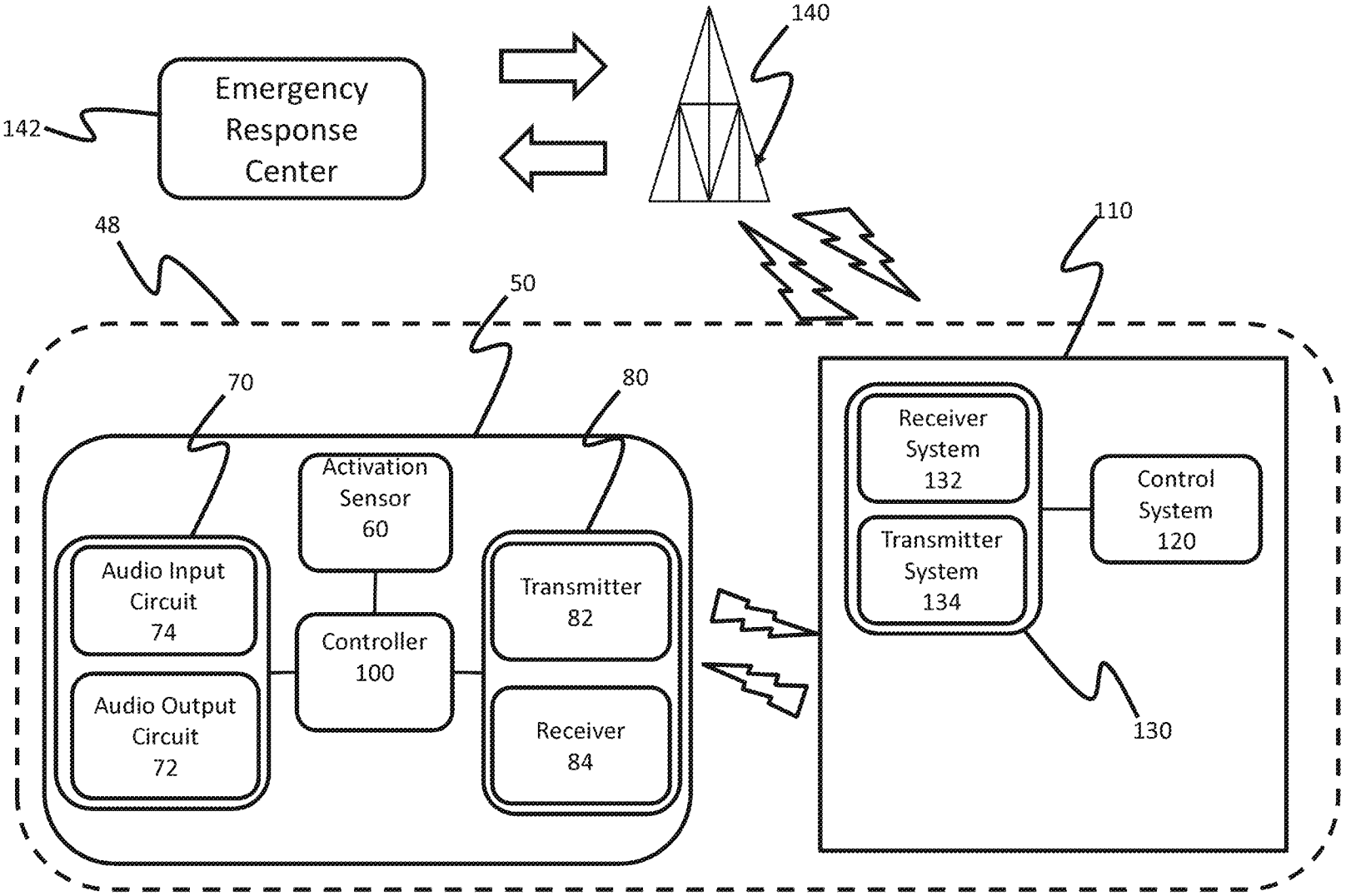
FIG. 3 shows a system diagram of a deterrent device wireless communication system.

Turning to is FIG. 3, there is shown a system diagram of a first embodiment of a deterrent device communication system 48 including a deterrent device communication apparatus 50 that is linked for movement with deterrent device 20 and a first embodiment of a local communication intermediate 110.

Deterrent device communication apparatus 50 can be linked for movement with deterrent device 20 in any fashion that allows deterrent device communication apparatus 50 to remain with deterrent device 20 when deterrent device 20 is in a ready position. Various mechanisms will be illustrated and described herein that establish a linkage between deterrent device 20 and deterrent device apparatus 50. These are not exclusive. This linkage can be made by way of fixing, joining, mounting, assembling, fusing or otherwise forming any structure that holds deterrent device communication apparatus 50 to deterrent device and is inclusive of the use of any type of fasteners, arrangements of pins and pin mountings adhesive bonding, whether through the use of adhesive materials between deterrent device 20 and deterrent device communication apparatus 50 or other forms of adhesive bonding, the use of welding, soldering, fasteners, rail mountings, slide mountings, compression fitting and any other known mechanism for forming such a bond including encasing enclosing or framing deterrent device communication system within components of deterrent device 20 or components that are joined to deterrent device 20. Such a linkage can be established by creating an attraction between magnetic, vacuum or other forces between deterrent device 20. Other mechanisms can also be used. Deterrent device 20 can be linked to deterrent device communication apparatus in a rigid manner that allows little freedom of movement of deterrent device communication apparatus 50 or that allows freedom of movement consistent with what is described and claimed herein.

In the embodiment of FIG. 3, deterrent device communication apparatus 50 has an activation sensor 60 mounted to deterrent device 20 and detects when deterrent device 20 transitions from a first, unused state, to a second state where deterrent device 20 is ready for use.

In one embodiment, activation sensor 60 can take the form of any kind of sensor that can detect when deterrent device 20 is gripped. Examples of such sensors can include but are not limited to pressure sensors, thermal sensors, switches, piezoelectric devices, and skin conduction sensors. When deterrent device 20 transitions from an unused state to a ready state, activation sensor 60 causes a change in an electrical, optical, or other wired or wireless signal received by a controller 100.

An interface system 70 is also mounted to deterrent device 20 and has at least an audio output circuit 72 with at least one circuit capable of generating human perceptible sounds and an audio input circuit 74 with at least one circuit capable of sensing sounds in the environment around deterrent device 20.

A wireless communication system 80 is mounted to deterrent device 20 and has a transmitter 82 and a receiver 84 capable of exchanging wireless communication signals with a separate local communication intermediate 110.

In this embodiment, controller 100 detects a signal from activation sensor 60 indicating that a user has transitioned deterrent device 20 from an unused state to a ready state and controller 100 causes transmitter 82 to transmit a transition signal indicating that this transition has occurred and causes receiver 84 to begin actively sensing for signals from local communication intermediate 110. Further, controller 100 causes audio input circuit 74 to sense sounds in the environment around deterrent device communication apparatus 50 and causes wireless communication system 80 to send signals including signals indicative of the sensed sounds to local communication intermediate 110.

Local communication intermediate 110 has a control system 120 and a wireless communication system 130 with a receiver system 132 that is capable of receiving signals from deterrent device communication apparatus 50 and a transmitter system 134 that is capable of transmitting signals that can be received by deterrent device communication apparatus 50. Additionally, receiver system 132 is capable of receiving signals from and transmitter system 134 is capable of sending signals to an external communication network 140 through which local authorities can be contacted. Receiver system 132 and transmitter system 134 can receive and/or transmit signals to external communication network 140 by way of wired or wireless communication circuits.

When receiver system 132 of local communication intermediate 110 detects a transition signal generated by deterrent device communication apparatus 50, receiver system 132 provides a signal to control system 120 indicating that a transition signal has been received. In response to this, control system 120 uses transmitter system 134 to generate signals directed to external communication network 140 to open a communication path with an emergency response center 142. Thereafter control system 120 causes receiver system 132 and transmitter system 134 to wirelessly relay signals including audio signals between deterrent device communication apparatus 50 and personnel at emergency response center 142 such as local law enforcement personnel or emergency response managers.

In one embodiment of this type, intermediate communication device 110 has a control system 120 with a programmable processor having a software program, application or other programmable instructions that when executed by the processor causes the intermediate communication device 110 to receive the wireless communication signals transmitted by the deterrent device communication apparatus and to open a communication path to emergency response center 142 in response to the received wireless communication signals.

It will be appreciated from the foregoing that simply by grasping a deterrent device 20 that is equipped with a deterrent device communication system 48, a homeowner can prepare to defend himself or herself while simultaneously opening line of communication with law enforcement or emergency response personnel. This advantageously brings the person holding deterrent device 20, who is likely in an unfamiliar and frightening situation, into immediate contact with law enforcement or emergency response personnel allowing trained personnel to help guide the person through the situation. Preferably, with such guidance, and with the timely intervention of law enforcement personnel the use of the deterrent device 20 will be unnecessary. Additionally, information obtained during such communications can help law enforcement and emergency response personnel to better assess the situation and provide guidance to law enforcement officers who are dispatched to the home.

The use of deterrent device communication apparatus 50 also advantageously enables the person holding deterrent device 20 to focus motor and visual effort on the management and direction of deterrent device 20 and eliminates the risks attendant with attempting to operate both a deterrent device 20 a local communication intermediate 110.

Figure 4:
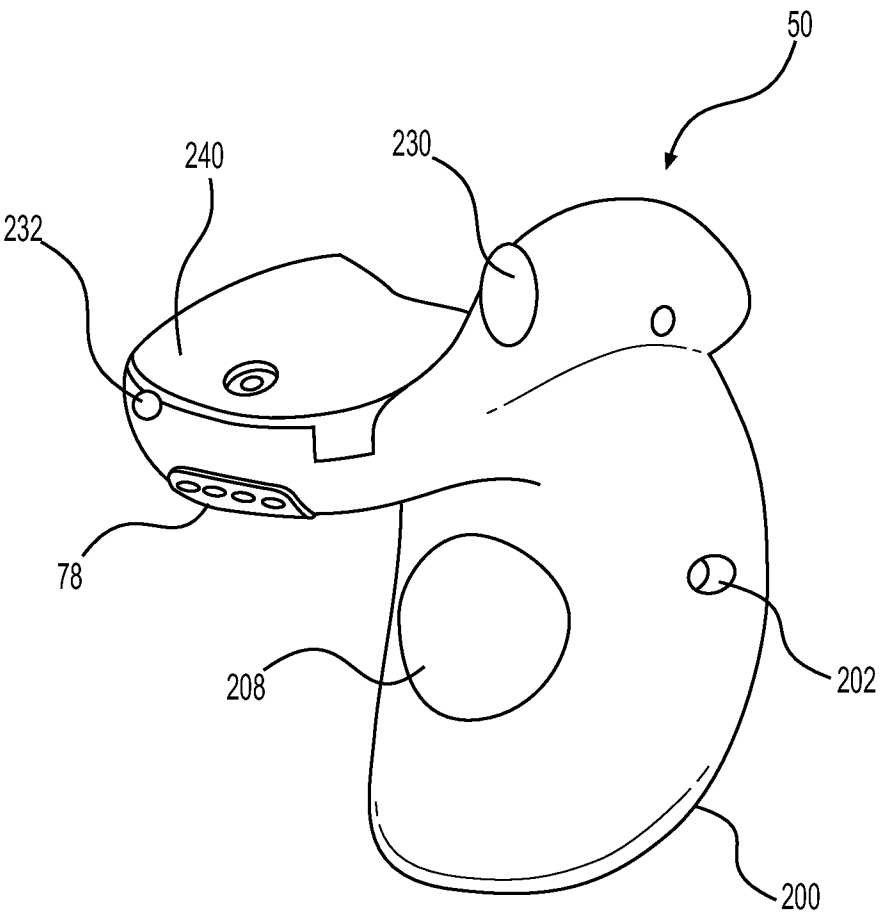
FIG. 4 is a right, top back isometric view of a first embodiment of a deterrent device communication apparatus 50.
Figure 5:
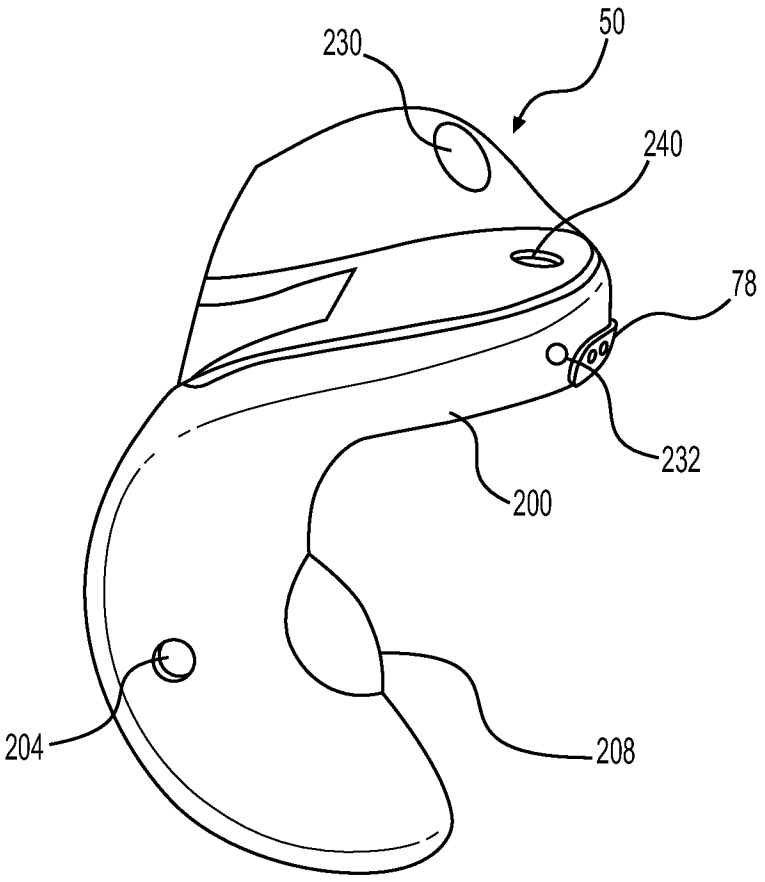
FIG. 5 is a left, top isometric view of the embodiment of FIG. 4.
Figure 6:
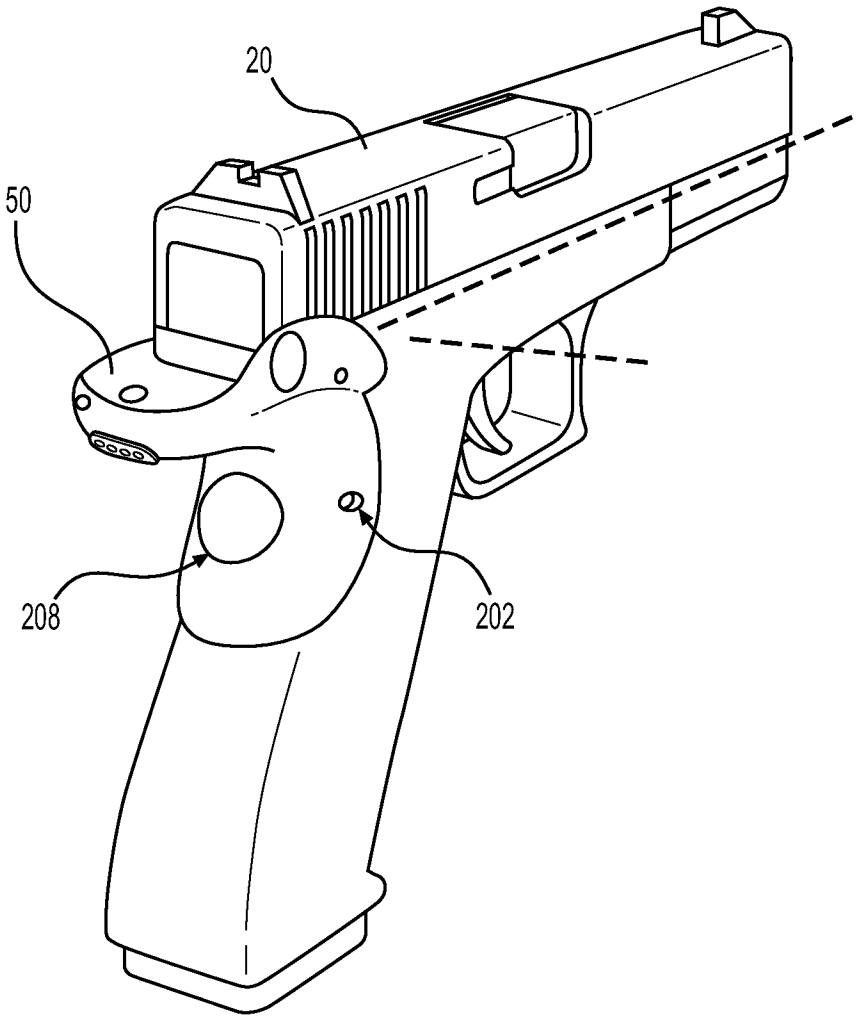
FIG. 6 is a right, top, back isometric view of the embodiment of FIG. 4 joined to the firearm of FIGS. 1 and 2.

FIG. 4 is a right, top back isometric view of a first embodiment of a deterrent device communication apparatus 50 and FIG. 5 is a left, top isometric view of the embodiment of FIG. 4. FIG. 6 illustrates the embodiment of FIG. 4 joined to the firearm of FIGS. 1 and 2. In the embodiment of FIGS. 4-6 deterrent device communication apparatus 50 has a housing 200 conforming to a profile of rear grip surface 44 of deterrent device 20. Two holes 202 and 204 are provided through housing 200 and are aligned with a passageway (not shown) in deterrent device 20 when housing is assembled against deterrent device 20. A roll pin (not shown) is be inserted through holes 202 and 204 to join housing 200 to deterrent device 20.

Figure 7:
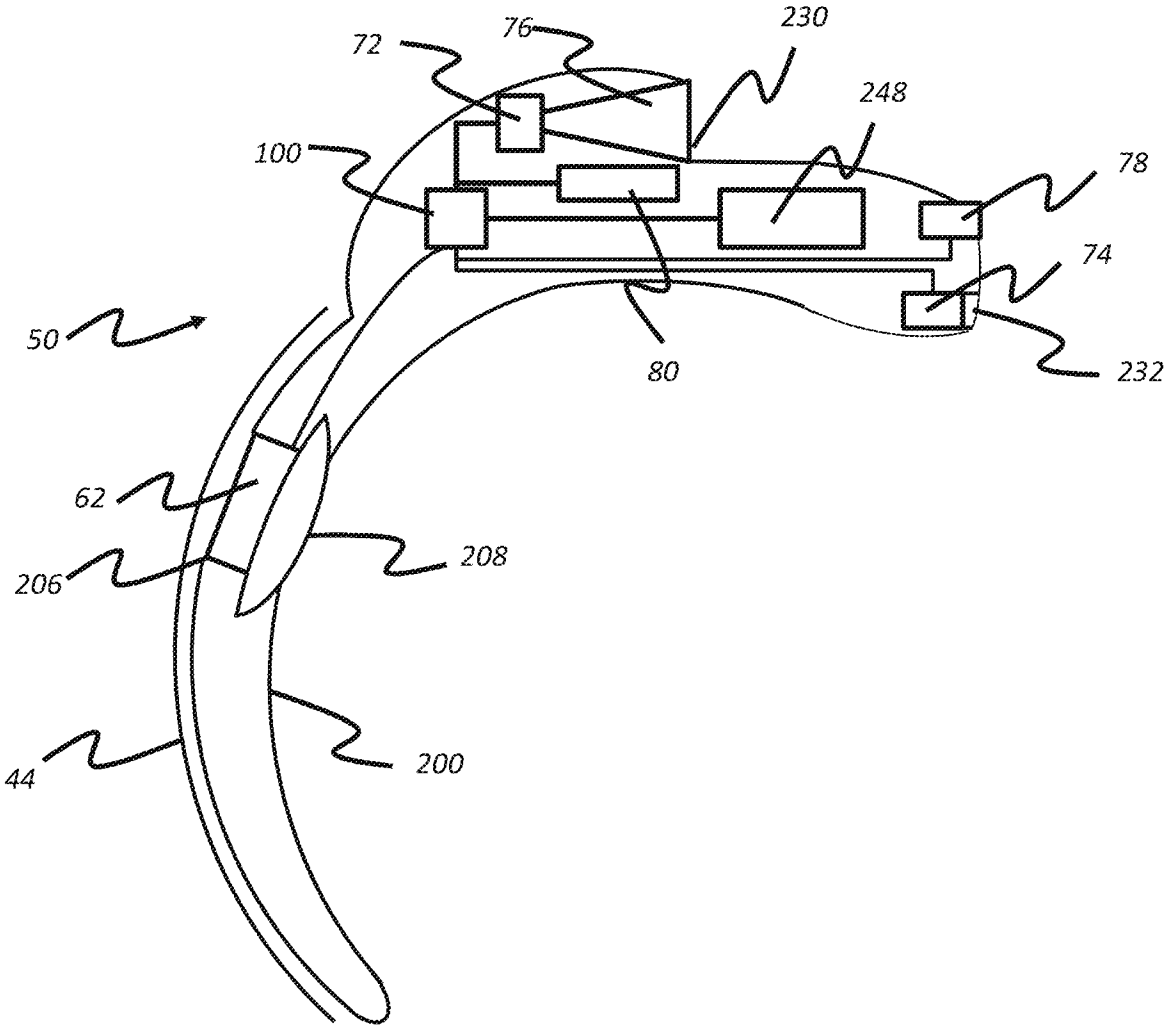
FIG. 7 is a schematic side view of one embodiment of deterrent device communication apparatus.

FIG. 7 is a schematic side view of the embodiment of FIGS. 4-6 alongside a rear grip surface 44. In this embodiment, activation sensor 60 takes the form of a momentary switch 62. Switch 62 is positioned in an opening 206 of housing 200 between a flexible cover 208 and rear grip surface 44 shown partially in FIG. 7. When a user grasps a deterrent device 20 equipped with deterrent device communication apparatus 50 switch 62 changes state creating a signal which controller 100 can determine that deterrent device 20 has been brought to a ready position.

As is described above, when controller 100 makes this determination, controller 100 causes wireless communication system 80 to generate a transition signal that can be sensed by local communication intermediate 110 causing local communication intermediate 110 to use external communication network 140 to open a wireless communication path between deterrent device communication apparatus 50 and law enforcement or emergency response authorities. Controller 100 causes wireless communication system 80 and audio output circuit 72 to cooperate to reproduce any audio content sent from law enforcement authorities and also causes audio input circuit 74 to capture audio signals in the environment about deterrent device communication apparatus 50 and further causes wireless communication system 80 to generate wireless signals that can be received by local communication intermediate 110 and transmitted thereby to emergency response center 142.

In some circumstances it may be beneficial to limit the extent to which people other than the person holding deterrent device 20 can overhear messages from audio output circuit 72. To limit the extent to which this can occur, the embodiment of FIGS. 4-6 includes a sound focusing element 76 between audio output circuit 72 and an audio output opening 230 in housing 200. In this embodiment, sound focusing element 76 comprises a conical structure that channels sound waves generated by audio output circuit 72 along a narrow path that is generally directed toward the user and presumably away from others. This approach also helps to prevent the possibility that sounds captured by audio input circuit 74 will include sound emitted by audio output circuit 72, thus preventing feedback related problems.

In the embodiment illustrated in FIG. 4-6, audio input circuit 74 is positioned proximate to an audio capture opening 232 in housing 200. As is shown in FIGS. 4 and 5, in this embodiment, audio capture opening 232 is optionally positioned on a left side of deterrent device communication apparatus 50 while audio output opening 230 is positioned on a right side of deterrent device communication apparatus 50. This optional arrangement can be made to further lower the risk that unwanted feedback will corrupt communications.

Additional optional features shown in the embodiment of FIGS. 3-6 include a manual user input 78. This manual user input can take the form of any kind of device that can sense a manual user input and provide a signal to controller 100. In one embodiment, the manual user input 78 can comprise a mute button enabling a user to silence audio output circuit 72 if necessary to enable the user to conceal his or her location. In another embodiment the manual user input 78 can be used to provide volume adjustments for audio output circuit 72. In still another embodiment, manual user input 78 can include a setting that instructs controller 100 to terminate communications.

Another additional optional feature shown in FIGS. 3-6 is a door area 240 positioned proximate to a power source 248 that allows easy access to power source 248 when it is necessary to change power source 248 and that does so without requiring that deterrent device communication apparatus 50 to be replaced.

In one mode of operation controller 100 is programmed to maintain communication with emergency response personnel until a release code is transmitted from the emergency response center. This allows law enforcement personnel to advise the user of deterrent device 20 that law enforcement authorities are aware that deterrent device 20 has been brought to a state of readiness and monitoring communications, leaving a person who has accessed the firearm for less noble purposes than home defense in the position of explaining why the weapon has been accessed and, if the user refuses to do so, law enforcement personnel can react.

Alternatively, in one embodiment, manual user input 78 can have the ability to receive an encoded entry communications with emergency response center 142. For example, manual user input 78 can have a plurality of inputs with each input having plurality of settings that must be set properly in order to allow a user to handle deterrent device 20 while deterrent device communication apparatus 50 is attached thereto without initiating contact with law enforcement authorities. For example, this may be used to allow handling of deterrent device 20 for purposes such as cleaning and maintenance of deterrent device 20.

Figure 8:
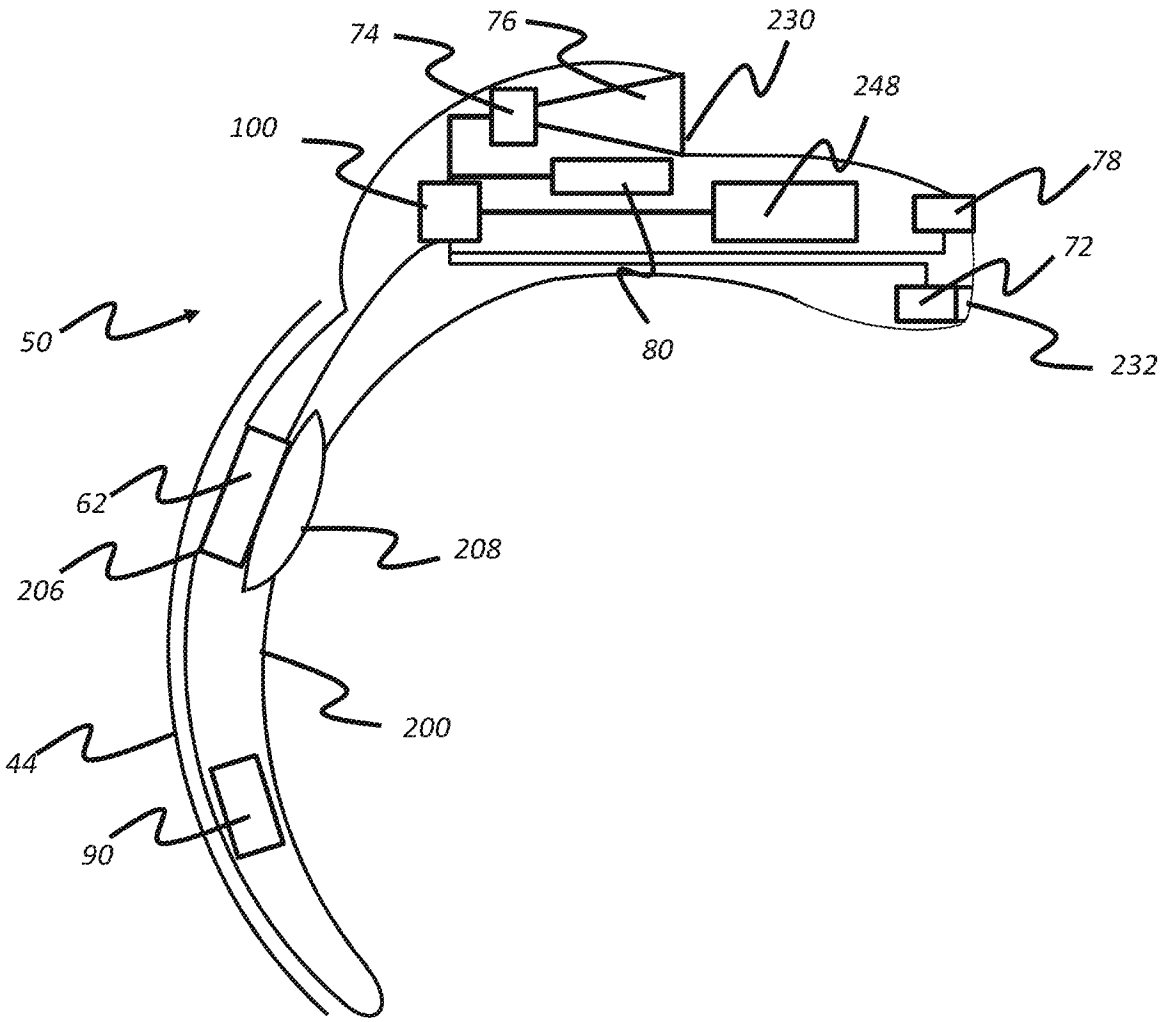
FIG. 8 is a schematic side view of another embodiment of deterrent device communication apparatus.

In one alternate embodiment, shown in FIG. 8, deterrent device communication apparatus 50 has a deterrent device sensor 90 that detects that deterrent device 20 is proximate to deterrent device communication apparatus 50. In one example, deterrent device sensor 90 is positioned proximate to one or more of holes 202 and 204 and provides a signal to controller 100 when an effort is made to remove deterrent device communication apparatus 50 from deterrent device 20.

Alternatively, deterrent device sensor 90 can sense the presence of deterrent device 20 such as by remaining in a first state when deterrent device 20 and deterrent device communication apparatus 50 are mounted together and transitioning to a second state deterrent device 20 and deterrent device communication apparatus 50 are separated. When separation is made controller 100 can determine whether manual user input 78 is in an appropriate state to authorize removal of deterrent device communication apparatus 50 and can initiate contact with authorities when the state of manual user input 78 is not consistent with owner authorization of the removal of deterrent device communication apparatus 50 from deterrent device 20.

Deterrent device sensor 90 can take many forms. For example, deterrent device sensor 90 can take the form of a micro-switch, dome switch, momentary switch, or other electromechanical optical switch positioned to sense the presence or absence of a surface of deterrent device 20 within a range of positions proximate to deterrent device communication apparatus 50 or that detect the presence or absence of fasteners joining deterrent device communication apparatus 50 to deterrent device 20 such as by detecting the presence or absence of a mounting pin at either of holes 202 and 204.

Alternatively, where deterrent device 20 has a frame made from a ferrous material, deterrent device 20 can use a transducer that varies its output as a function of changes in a magnetic field proximate thereto. In one example of this type, a deterrent device sensor 90 can comprise a Hall effect sensor.

Deterrent device sensor 90 can take other forms, including optical sensors that detect ambient or reflected light levels between deterrent device 20 and deterrent device communication apparatus 50, conductivity sensors that sense a change in the conductivity between deterrent device communication apparatus 50 and deterrent device 20 or between fasteners that join deterrent device communication apparatus 50 to deterrent device 20.

Figure 9:
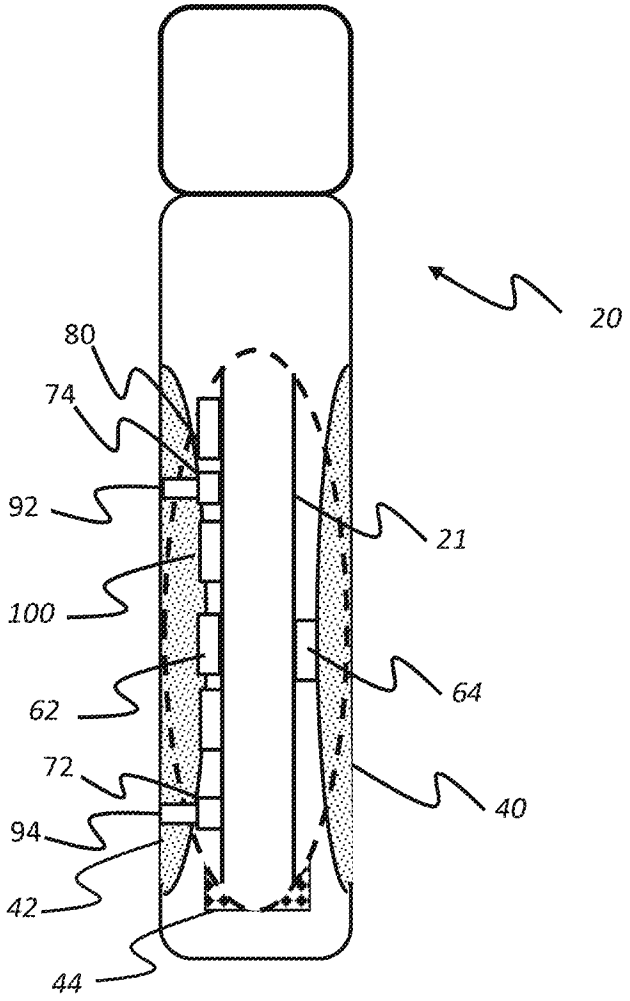
FIG. 9 is a rear elevation of the deterrent device of FIGS. 1 and 2 with a cutaway to reveal an embodiment of deterrent device communication apparatus mounted within the deterrent device.

In other embodiments, deterrent device communication apparatus 50 or any components thereof can be mounted to deterrent device 20 other than by way of housing 200 For example, the embodiment of FIG. 9 illustrates a rear schematic view of deterrent device 20 having an embodiment of a deterrent device communication apparatus 50 that is mounted to deterrent device 20 by incorporating various components of deterrent device communication apparatus 50 into areas of deterrent device 20 proximate to side grips 40 and 42 and frame 21. As is shown in the embodiment of FIG. 9, an activation sensor in the form of a switch 62 is positioned between second grip 42 and frame 21 that changes state when second grip 42 is pressed against frame 21. Additionally, in this embodiment, wireless communication system 80 and controller 100 are positioned in a region between frame 21 and an exterior surface of second grip 42. An optional additional activation sensor shown as a switch 64 is provided in the embodiment of FIG. 8 allowing for sensing of a gripping force on an opposite side of frame 21.

Controller 100 is connected to switch 62 and optionally to switch 64 and detects when a signal from switch 62 or switch 64 indicates that deterrent device 20 has transitioned from an unused state to a ready state.

Controller 100 is also connected to interface system 70 and wireless communication system 80 and operates as is generally described above when a transition is detected. In the embodiment of FIG. 8, audio input circuit 74 is illustrated positioned generally at or between second grip 42 and frame 21 and an input channel 92 is positioned to allow sounds to reach audio input circuit 74 through second grip 42. Similarly audio output circuit 72 is illustrated positioned generally at or between second grip 42 and frame 21 and an output channel 94 is positioned to allow sounds from audio input circuit 74 through second grip 42. In this embodiment, input channel 92 is located on an upper region of second grip 42 to lower the risk that input channel 92 will be covered when a user grips deterrent device 20. Similarly, in this embodiment, output channel 94 is located in a lower region of second grip 42 to lower the risk that output channel 94 will be covered when a user grips deterrent device 20. As is also shown in this embodiment, input channel 92 and output channel 94 are located apart from each other vertically in order to lower the risk of feedback based interference.

In any embodiment, either controller 100 or control system 120 can be programmed to include data with any initial or subsequent transmission to law enforcement personnel. This data can include preprogrammed information such as a name, image, biometric data, or identification information for the owner of or authorized user(s) of deterrent device 20, an address where deterrent device 20 is stored, and the type of deterrent device 20. Other arrangements are possible.

A common problem experienced when people use cellular telephones to contact 911 type emergency centers is that such centers do not have inherent abilities to detect the location of the cellular phone. Similar problems occur when Internet-based communications are used to communicate with local emergency response centers. Accordingly, in one embodiment, a user of the deterrent device communication system 48 can preprogram local communication intermediate 110 so that local communication intermediate 110 will contact a specific emergency center that can be most helpful to the homeowner. Information identifying such a preferred emergency contact center can be stored in deterrent device communication apparatus 50 or in intermediate communication device 110 for use as needed. Additionally, a prioritized list of emergency response centers can also be stored in similar fashion against the possibility that a preferred emergency response center is unavailable.

Similarly, deterrent device communication apparatus 50 or intermediate communication device 110 can provide location information directly to the local authorities to avoid any confusion as to the location of the deterrent device. Such information can be statically programmed or dynamically determined using GPS or other location information.

In any embodiment, control system 120 can be programmed not to provide any outward indication that control system 120 received the transition signal and has initiated communication with law enforcement personnel. In this way, a homeowner does not have to be concerned that a local communication intermediate 110 left in a place where it might be observed by a home invader will reveal that the phone is being used to contact authorities.

It is well known that cellular telephone technologies require significant amounts of power to operate such that the light and mid-weight batteries that are used give cellular telephones even a few days of standby time would greatly increase the size and weight of a firearm or other deterrent device and still require essentially constant recharging.

Accordingly, wireless communication system 80 and wireless communication system 130 can comprise circuits or systems that are adapted to use well known communication standards such the Bluetooth communication standard in order to communicate between deterrent device communication apparatus 50 and intermediate communication device 110 and that allow transmitter 82 to generate signals that are less than 100 mW in power, and that in some embodiments can be as low as 2.5 mW or lower in order to establish communication with intermediate communication device 110. By controlling the power output of such a transmitter, smaller batteries on the order of 10 cubic centimeters in volume or smaller can be used. Intermediate communication device 110 can use conventional cellular protocols such as GSM or CDMA to establish communication with external communication network 140.

Alternatively, local communication intermediate 110 can use for example a wired telecommunication network, data communication network other than a telecommunication network or Internet based telephony or other Internet based communications to open a communication path enabling two way communications with local law enforcement personnel or emergency response personnel. For example, the intermediate communication device 110 can take the form of a tablet computing device such as a Nexus tablet sold by Google, Inc. Mountain View, Calif., or an iPod or iPad sold by Apple Computer, Inc. Cuppertino Calif., a personal computer, a wireless router, any programmable computing device, telecommunications equipment or a server. Intermediate communication device 110 can also take the form of a combination of dedicated hardware devices capable of performing the functions required by any embodiment described herein.

Additionally, in some embodiments, local communication intermediate 110 can comprise a security monitoring system. Such a system can include for example security systems having perimeter, motion or other security sensors. Where such a systems acts as a local communication intermediate 110 such systems can optionally provide information to emergency response personnel based upon perimeter, motion or other sensors in the home or environment. For example, such systems may detect movement of the perpetrator within the home or the breaking of or opening of a window or door as a means of exit for the perpetrator and may provide this information to the homeowner or to emergency response personnel. For example, in one embodiment a home security system may sense the opening of a door or movement in a particular area of the home and provide a synthesized voice indicating which door has been opened or in what room of the home motion has been detected. Alternatively, information can be transmitted by the home security system type local communication intermediate to local law enforcement or emergency response personnel from which such emergency response personnel can determine what has transpired and can advise the homeowner.

A local communication intermediate 110 of the type that has a can be configured to contact an emergency response center associated with private security monitoring services such as those offered by ADT Corporation, Boca Raton, Fla., USA, and others. In such cases, communication can be established between deterrent device communication apparatus 50 and an emergency response center at the security monitoring services that can provide guidance to the homeowner and can also connect the homeowner with local law enforcement personnel. In cases where such monitoring services also employ private security personnel such personnel can be dispatched.

It will be appreciated that while the foregoing discussion has described the importance of deterrent device communication system 48 in the context of a home invasion, deterrent device communication system 48 is not so limited. Indeed, deterrent device communication system 48 may be useful in any perimeter defense circumstance including but not limited to during a criminal invasion of an apartment, mobile home, or campsite. Deterrent device communication system 48 can also be useful during invasions of other spaces including commercial and governmental spaces.

Figure 10:
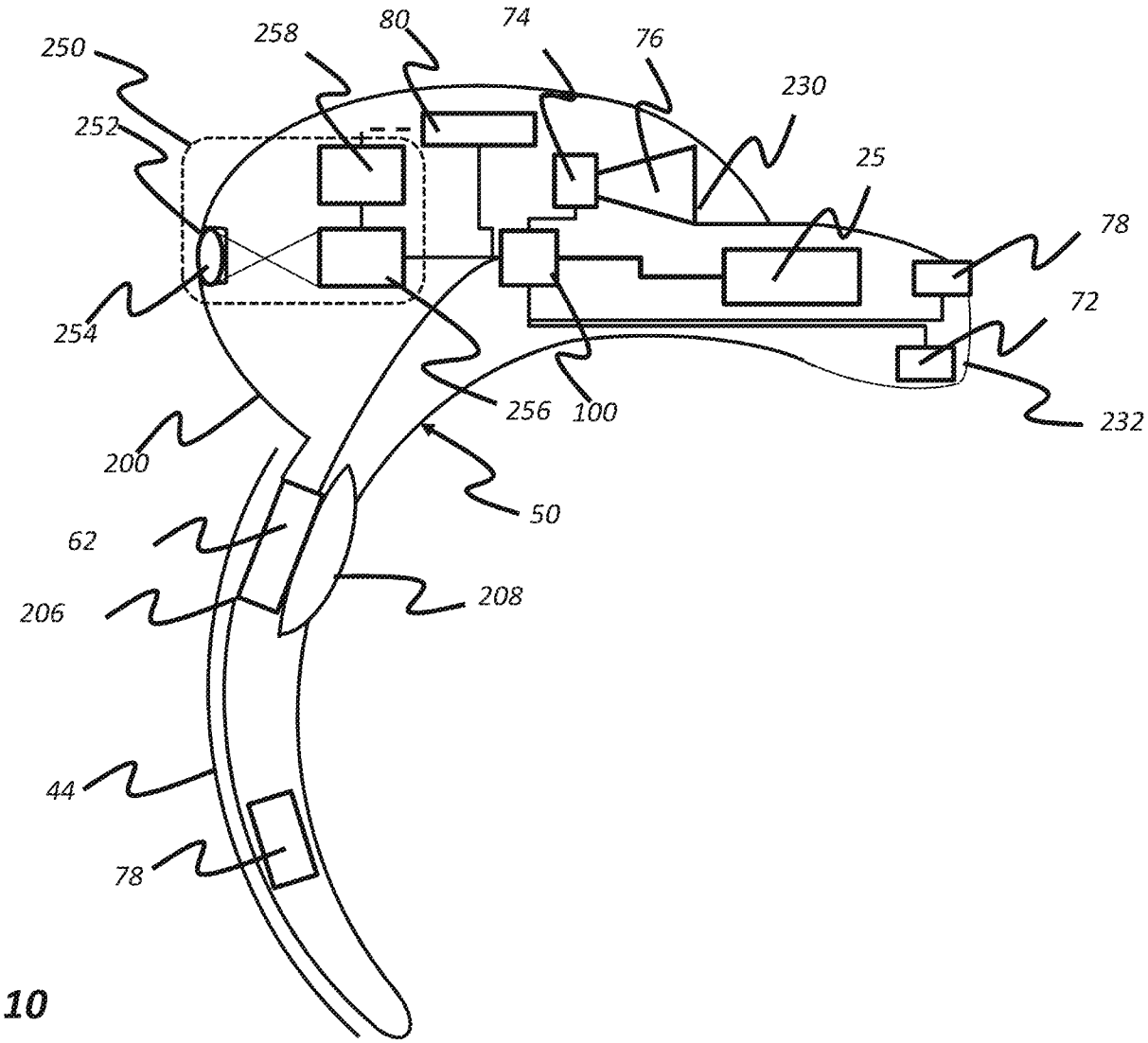
FIG. 10 shows another embodiment of deterrent device communication apparatus of FIGS. 3-8 having an image capture system.

FIG. 10 shows another embodiment of deterrent device communication apparatus 50 described herein in reference to FIGS. 3-8 having an image capture system 250. In the embodiment of FIG. 10, image capture system 250 has an aperture 252 allowing light into housing 200, an optional lens system 254, an image sensor 256, and a signal processor 258. In operation, light from a scene is focused by lens system 254 to form an image on image sensor 256. Lens system 254 can have one or more elements. Lens system 254 is preferably of a fixed focus type. However, lens system 254 can optionally be adjustable to allow the user or manufacturer to provide focus or zoom adjustments. In some embodiments, scene focusing can be accomplished without lens system 254 by providing an aperture 252 that is sized and positioned apart from image sensor 256 so as to cause an image to form on image sensor.

Light from the scene that is focused by lens system 254 onto image sensor 256 is converted into image signals representing an image of the scene. Image sensor 256 can comprise a charge coupled device (CCD), a complementary metal oxide semiconductor (CMOS), or any other electronic image sensor known to those of ordinary skill in the art. The image signals can be in digital or analog form. Signal processor 258 receives image signals from image sensor 256 and transforms the image signal into a digital image in the form of digital data. In the embodiment illustrated, signal processor 258 has an analog to digital conversion capability. Alternatively, a separate analog to digital converter (not shown) can be provided to convert the image signals into digital data which is then provided to signal processor 258. In this latter embodiment, signal processor 258 can comprise a digital signal processor adapted to convert the digital data into a digital image. The digital image can comprise one or more still images, multiple still images and/or a stream of apparently moving images such as a video segment. Where the digital image data comprises a stream of apparently moving images, the digital image data can comprise image data stored in an interleaved or interlaced image form, a sequence of still images, and/or other forms known to those of skill in the art of video.

Signal processor 258 can apply various image processing algorithms to the image signals when forming a digital image. These can include but are not limited to color and exposure balancing, interpolation and compression.

It will be appreciated that incorporating an image capture system 250 into deterrent device communication apparatus 50 can have a number of effects on the design of deterrent device communication apparatus 50. For example this can significantly increase both the volume and the rate at which wireless communication system 80 is required to capture, process, and transmit data to local communication intermediate 110. Such increases, in turn, can cause an increase in power consumption of deterrent device communication apparatus 50. Accordingly, in some embodiments, it can be useful to provide an image capture system 250 that is arranged in ways that reduce volume and extent amount of data to be processed and/or that reduces the amount of image processing that must be performed before such image data can be sent to local communication intermediate 110.

In one aspect the volume of video data that must be transmitted can be controlled by limiting the resolution of image sensor 256 to resolution levels that can be useful to law enforcement or emergency response personnel but that limit the volume of image information so as to allow deterrent device communication apparatus 50 to maintain a size and weight that do not interfere with normal handling and operation of deterrent device 20. For example, image sensor 256 can take the form of a VGA image sensor having 640 rows and 480 columns of picture elements, or a Quarter VGA image sensor having 480 rows and 240 columns of picture elements, or even a Quarter Quarter VGA image sensor having 160 rows and 120 columns of picture elements. However, it will be understood that these sizes are provided by way of illustration only and that it may be or may become practical to incorporate imagers that are larger than these example imagers while still allowing deterrent device communication apparatus 50 to maintain an unobtrusive weight and size profile.

Alternatively, the rate at which image sensor 256 captures images can be adjusted to reduce the overall volume of and the rate at which image data must be processed and transmitted by deterrent device communication apparatus 50. For example, image capture rates of 30 frames per second are known to provide video streams that do not appear to have significant amounts of flicker in them. However, image capture rate rates as low as one frame every other second may be useful to law enforcement and emergency response personnel. It will be appreciated that careful definition of the image capture rate can also be used to control the amount of data that must be captured, processed and transmitted in order to help allow deterrent device communication apparatus 50 maintain a desirable size and weight profile. In general, the capture, processing and transmission of image streams at lower frame rates requires less energy than the capture, processing and transmission of image streams at higher frame rates. Additionally, in some cases, the cost, size, and complexity of equipment required to capture, process, and transmit image streams having lower frame rates will be lower than the size, complexity and cost of equipment required to, process and/or transmit image streams at higher frame rates.

In further embodiments, the extent to which image frames are processed to form video streams within deterrent device communication apparatus 50 can be adjusted so as to reduce power, memory or processing requirements of deterrent device communication apparatus 50 the weight or size of deterrent device communication apparatus 50. For example, the size, complexity, weight, cost or power consumption of image processing systems within deterrent device communication apparatus 50 may be lower when image processing systems are required to do less processing of the captured images than when such image processing systems are required to do more processing of the captured images.

In various embodiments herein, image sensor 256 may be a conventional color image sensor capable for providing color information for each pixel. However, in other embodiments, image sensor 256 can take the form of a monochrome imager. In some embodiments, the monochrome imager may provide advantages terms of increased sensitivity at each picture element, reduced processing requirements as the need to perform color interpolation is eliminated, and smaller video streams as data for only one color channel must be included in the video stream.

Image sensor 256 can be sensitive to both visible wavelengths of light as well as wavelengths that are not visible such as infrared light. In some embodiments of this type, an image capture sensor that is sensitive to visible wavelengths of light will also be sensitive to adjacent invisible wavelengths. This can create image artifacts in the visible images. Accordingly, some image sensors and image capture systems use infrared filters to block such artifacts and such imager and image capture systems can be made at least partially sensitive in the infrared wavelengths by removing these filters. Optionally, image capture system 250 and image sensor 256 can include capabilities to enable low light image capture.

It will be appreciated that transmitting streaming video data can require the use of a higher high speed data communication protocol than transmitting only audio data. In one embodiment, deterrent device communication apparatus 50 can utilize high speed local communication protocols such as those defined in the Institute for Electronic and Electrical Engineers standard 802.11 including but not limited to 802.11b, 802.11g, 802.11n and any successors thereto. However in other embodiments, any other local communication protocol can be used. Optionally communications between deterrent device communication apparatus 50 and local communication intermediate 110 can be encrypted using for example Wired Equivalent Privacy (WEP), Wireless Application Protocol (WAP), Advanced Encryption Standard (AES) or other known encryption strategies.

Figure 12:
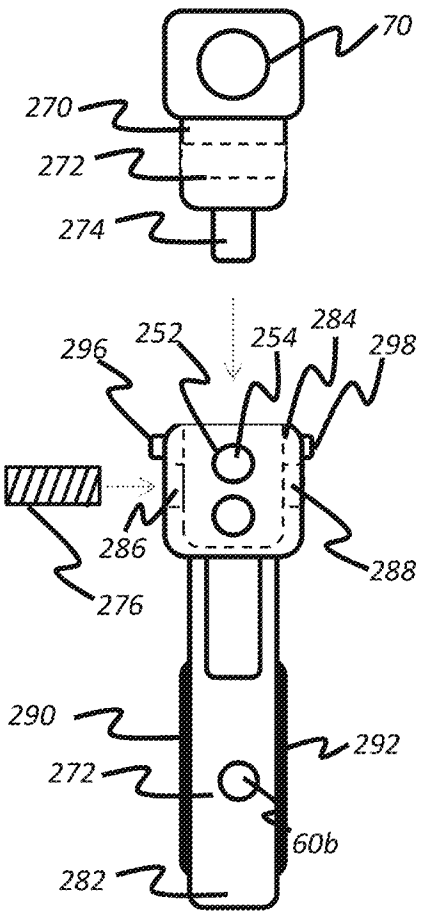
FIGS. 11 and 12 illustrate, respectively, side and front assembly views of another embodiment of a deterrent device communication apparatus.
Figure 11:
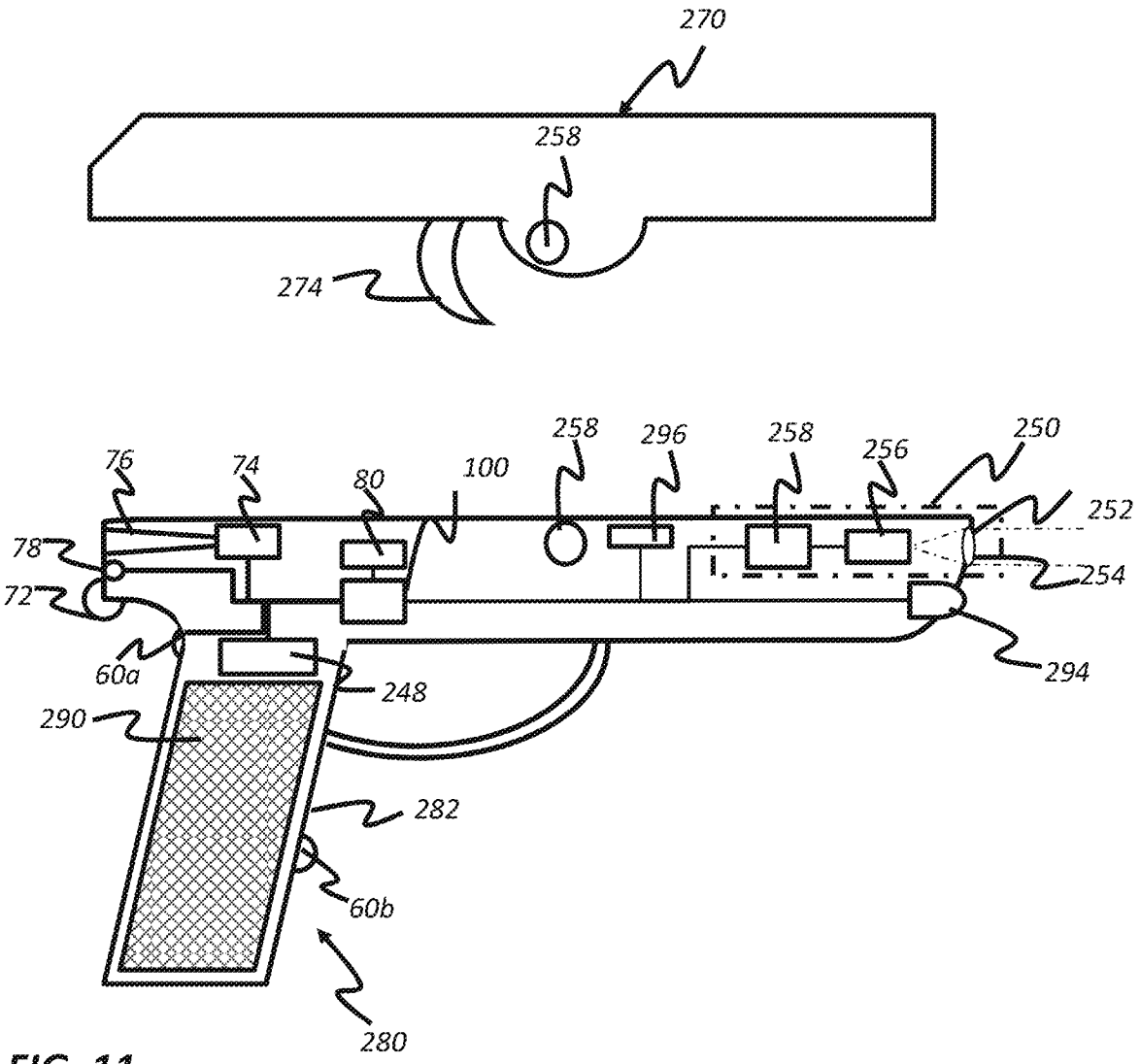

FIGS. 11 and 12 illustrate, respectively, side and front assembly views of another embodiment of a deterrent device communication apparatus 50. In this embodiment, deterrent device 20 comprises a firearm assembly 270 and a separable handle 280. In the embodiment of FIGS. 11 and 12, firearm assembly 270 comprises all of the components necessary to enable a bullet to be discharged from firearm assembly 270 when trigger 274 is moved.

In the embodiment that is illustrated in FIGS. 11 and 12 components of deterrent device communication apparatus 50 takes the form of a separable handle 280 that has a handle housing 282 with a recess area 284 shown in phantom in FIG. 12 into which firearm assembly 270 can be positioned. When firearm assembly 270 is positioned in recess area 284, openings 286 and 288 in handle housing 282 align with a passageway 272 in firearm assembly 270 into which a screw 276 or other fastener can be located in order to hold firearm assembly 270 and separable handle 280 together. Firearm assembly 270 and separable handle 280 can be joined together in other ways.

Deterrent device communication apparatus 50 includes interface system 70, with audio input circuit 74, optional sound focusing element 76, manual user input 78. Additionally a 72 is provided to allow manual user input and an activation sensor 60 is positioned in an area where a gripping or other condition from which it can be determined whether deterrent device 20 has been moved from an unused position to a ready position. A controller 100 and wireless communication system 80 are also provided and operate as is generally described in greater detail above. Components of deterrent device communication apparatus 50 can be assembled to, joined to, mounted to, fixed to or fabricated in situ or along with separable handle 280.

As is shown in this embodiment, this arrangement provides opportunities for alternative physical locations for arrangements of components of deterrent device communication apparatus 50. For example, in this embodiment, an image capture system 250 with an aperture 252 allowing light into housing 200, an optional lens system 254, an image sensor 256, and a signal processor 258 are positioned forward of handle portion 282 and are arranged to capture an image of a scene including a portion of the scene that includes a target area within which a deterrent such as a projectile, chemical dispersant, directed energy or other deterrent is directed.

In the embodiment that is illustrated in FIG. 11, aperture 252 and image sensor 256 are shown arranged parallel to a passageway of barrel 25. However, in other embodiments, aperture 252 and image 256 can be arranged along non-parallel axes.

As is shown in FIG. 12, in this embodiment image capture system 250 is positioned under firearm assembly 270. In one embodiment, this can be done to reduce the width of the combined deterrent device 20 and deterrent device communication apparatus 50.

As is also shown in the embodiment of FIGS. 11 and 12 deterrent device communication apparatus 50 can incorporate an optional light emitter 294. Light emitter 294 can take the form of an illuminator or the form of a strobe that emits a brief flash of light or a series of flashes of light to dazzle an intruder and to provide improved target recognition or image quality. Light emitter 294 can also take the form of an aiming laser such as a bore aligned laser. In embodiments where image sensor 256 is sensitive to non-visible wavelengths of light such as infra-red and ultra-violet light in addition to visible wavelengths, light emitter 294 can generate supplemental non-visible light to enhance the quality of the image captured by image capture sensor 254. In another alternative embodiment, light emitter 294 can include more than one type of light emitter such as a laser aiming device and a visible illuminator. Light emitter 294 can be selectively activated through one or more user controllable switches 296 and 298 positioned on housing 282.

As is also shown in FIGS. 11 and 12, activation sensor 60 can be positioned as is generally described above and as is shown in FIGS. 11 and 12 as activation sensor 60*a*, or in an alternative embodiment an activation sensor can be positioned as shown by activation sensor 60*b*, or elsewhere on housing 282. In circumstances where housing 280 has flexible a grip surface such as side grip surfaces 290 and 292, activation sensor 60 can be positioned between side grip surfaces 290 and 292 and housing 282 to sense gripping in such areas as is generally described in greater detail elsewhere herein.

Figure 13:
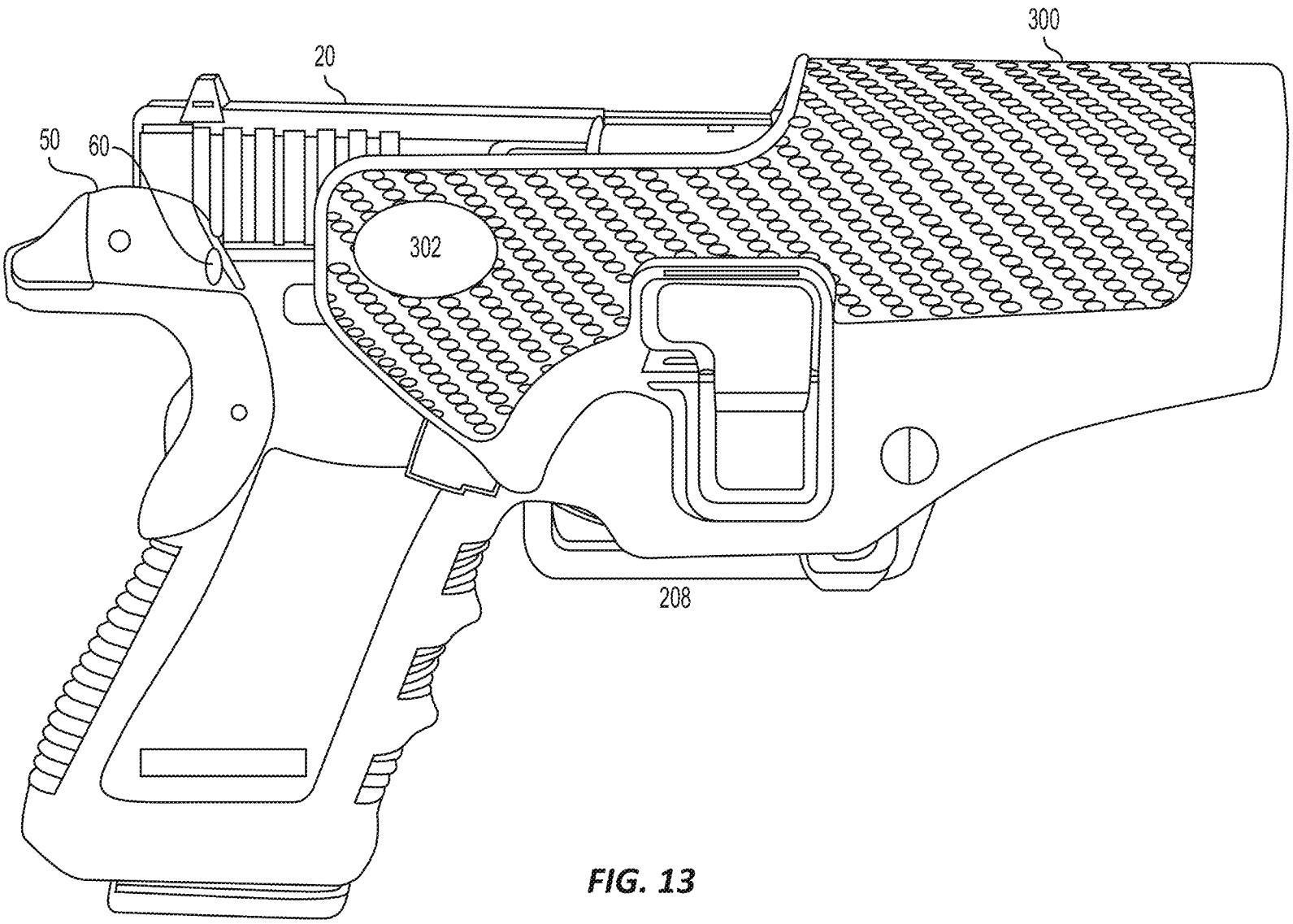
FIG. 13 illustrates a deterrent device having a deterrent device communication apparatus maintained in a holder shown as a holster and an embodiment of an activation sensor comprises a sensor that can detect when deterrent device is removed from the holder.

In other embodiments, activation sensor 60 can be adapted to sense other actions indicating that deterrent device 20 has been brought from an unused position to a ready position. For example, in the embodiment illustrated in FIG. 13, deterrent device 20 is maintained in a holder 300 shown as a holster and activation sensor 60 comprises a sensor that can detect when deterrent device 20 is removed from a holder 300 shown in FIG. 13 as a holster. In one embodiment, activation sensor 60 can take the form of contact sensor that can sense pressure applied against housing 200 by holder 300 such as a mechanical switch or piezoelectric sensor or any other transducer that can sense the release of some pressure against housing 200.

In another embodiment, activation sensor 60 can take the form of a Hall effect sensor, radio frequency sensor or other sensor that can detect a change in a magnetic or electromagnetic field surrounding housing 200. In one example of such an embodiment, holder 300 has a magnet positioned near an opening 302 generating a magnetic field in holder 300 the intensity of which will weaken as deterrent device 20 is removed from holder 300. In still another embodiment, activation sensor 60 can take the form of a light sensor that detects a change in an amount of light received by activation sensor 60 as deterrent device 20 is removed from holder 300. Other methods and sensors for detecting the removal of deterrent device 20 from holder 300 can be used in like fashion. Holder 300 can take other forms including but not limited to lockable weapon holders such as a mechanically or electro-mechanically locked enclosure.

Figure 14:
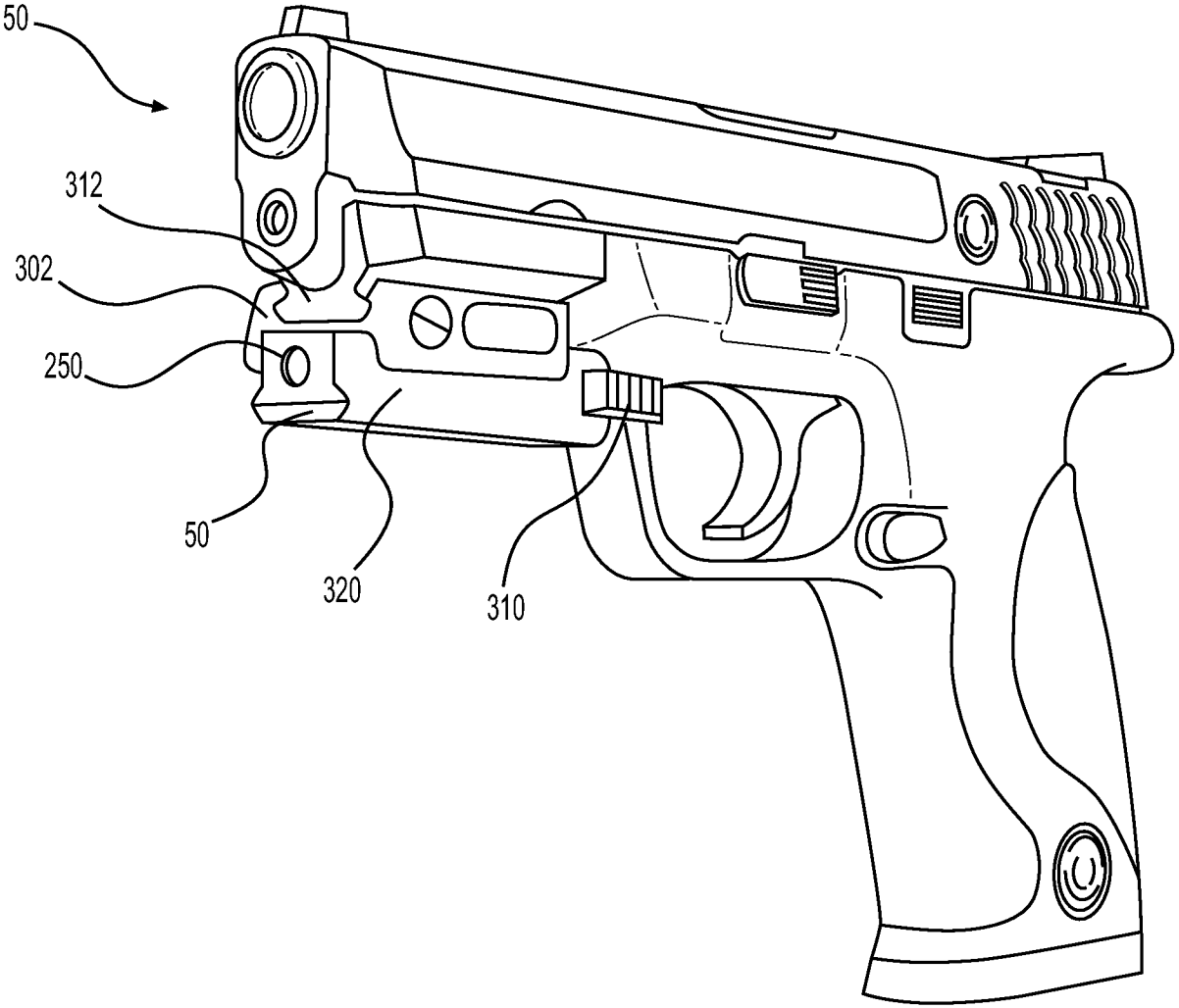
FIG. 14 is a front and side isometric view of a further embodiment of a deterrent device communication apparatus joined to a deterrent device.
Figure 15:
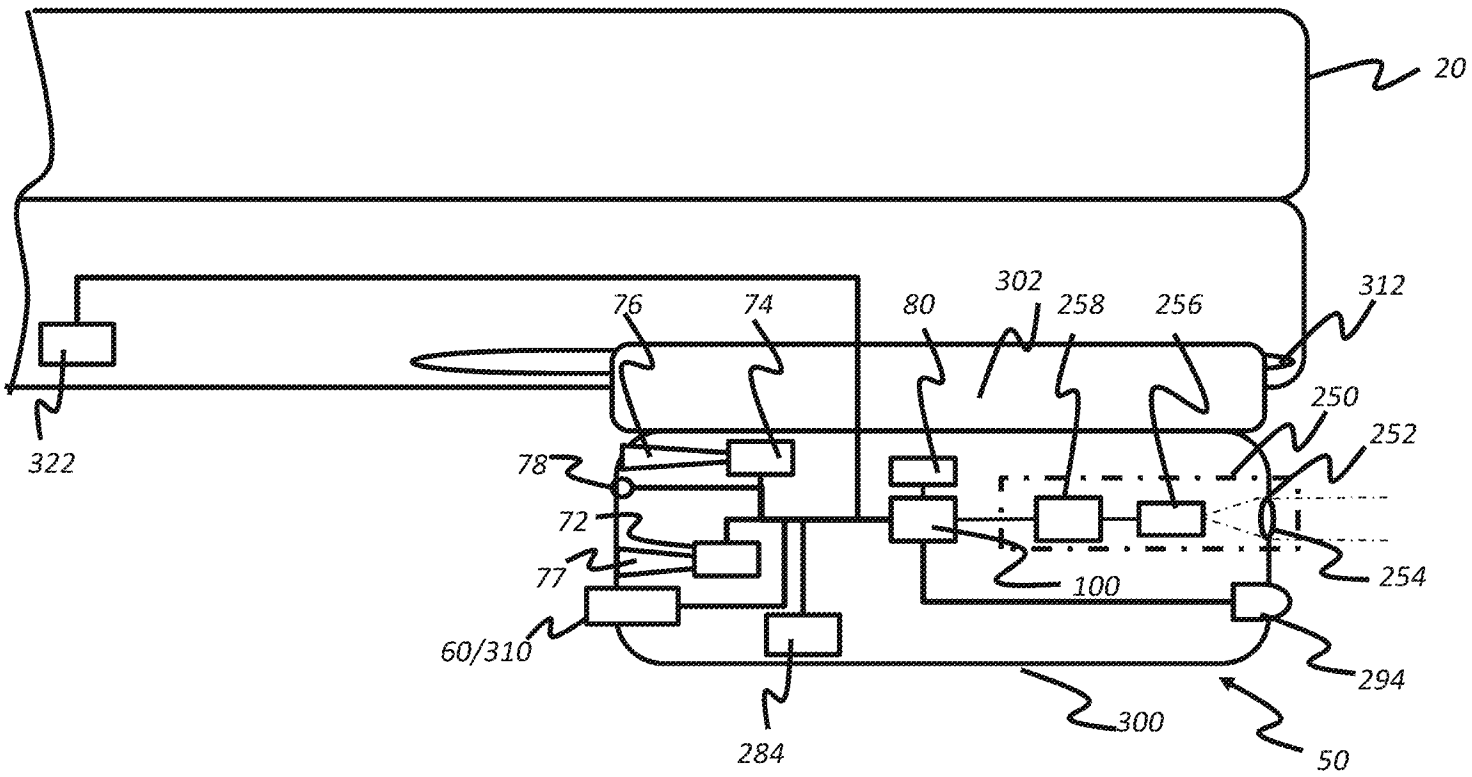
FIG. 15 is a schematic view of a further embodiment of the deterrent device communication apparatus of FIG. 14 joined to a deterrent device.

FIG. 14 is a side front isometric view of a deterrent device 20 having yet another embodiment of a deterrent device communication apparatus 50 while FIG. 15 is schematic view of deterrent device communication apparatus 50 of FIG. 14 with a cut away portion of deterrent device 20. In this embodiment, deterrent device communication apparatus 50 has a housing 306 with a mounting portion 308 that is mechanically joined to deterrent device 20 by way of a rail structure 312. As is shown here, housing 306 in this embodiment contains an, activation sensor 60, an interface system with an audio output circuit 72, and audio input circuit 74, a sound focusing element 76, and a manual user input 78, a wireless communication system 80, a controller 100, and a power source 248 such as a battery. In the embodiment that is illustrated, power source 248 can comprise a battery that stores enough power to enable 30 minutes of communications.

In this embodiment, housing also contains an optional image capture system 250 having a lens 254 that receives light from a scene through an aperture 252 in housing 306 an image sensor 256 and a signal processor 258. These components generally operate as is described above when activation sensor 60 senses a condition from which it can be determined that deterrent device 20 is in a ready state.

In this embodiment, activation sensor 60 is shown taking the form of a slide switch 310 that a user can slide to activate deterrent device communication apparatus 50. When this occurs, activation sensor 60 and controller 100 cooperate with other components of deterrent device communication apparatus 50 to operate as is generally described above and any and all components of deterrent device communication apparatus 50 may be located in a housing 200 that is joined to the rail structure 312 of deterrent device 20.

The embodiment of FIGS. 14 and 15 is optionally provided with a directed sound concentrator 77 that concentrates sounds from a direction of the user of deterrent device 20 so that the user can speak quietly yet still be heard by emergency response personnel receiving a transmission from deterrent device communication apparatus 50. In one embodiment of this type directed sound concentrator 77 can be positioned on one side of deterrent device communication apparatus 50, while sound focusing element 76 is positioned on an opposite side of deterrent device communication apparatus 50. Directed sound concentrator 77 in this embodiment comprises a conical shaped structure that receives and concentrates sound waves from a direction of the user of deterrent device onto audio input circuit 74. Both sound focusing element 76 and directed sound concentrator 77 can be fixed or adjustable. In one embodiment, adjustable sound focusing or directed sound concentration can be achieved as described in U.S. Pat. No. 4,862,278 entitled "Video camera microphone with zoom variable acoustic focus".

As is also illustrated in FIG. 15, in this embodiment an optional light emitter 294 is provided. In one embodiment, light emitter 294 can be activated when slide switch 310 is moved to a proper position. Alternatively, a separate switch 322 can be mounted to deterrent device 20 and joined so that deterrent device communication apparatus 50 can be connected thereto and activated way of this manipulation of switch 310.

Figure 16:
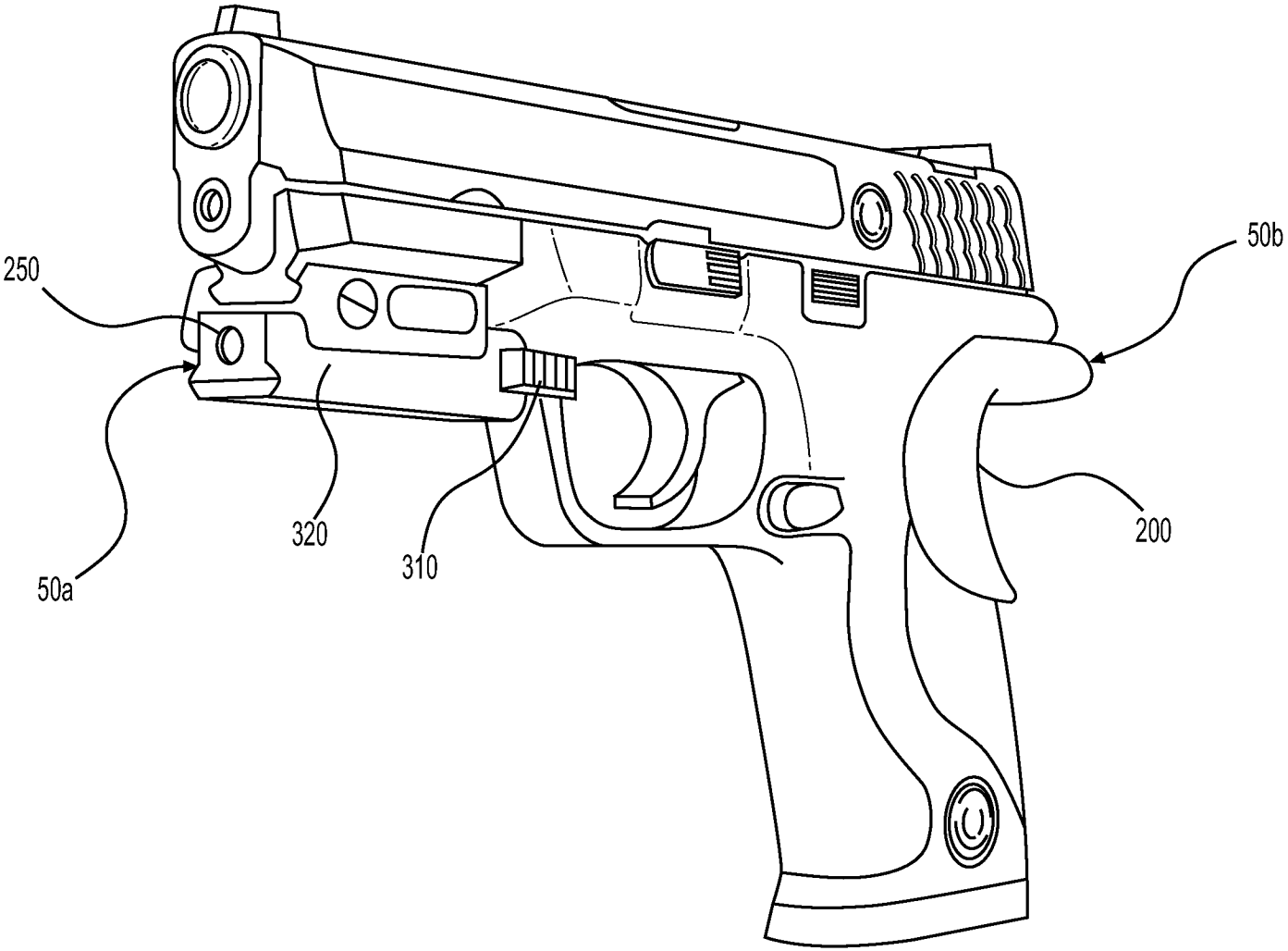
FIG. 16 is a front and side isometric view of yet another embodiment of a deterrent device communication apparatus joined to a deterrent device.
Figure 17:
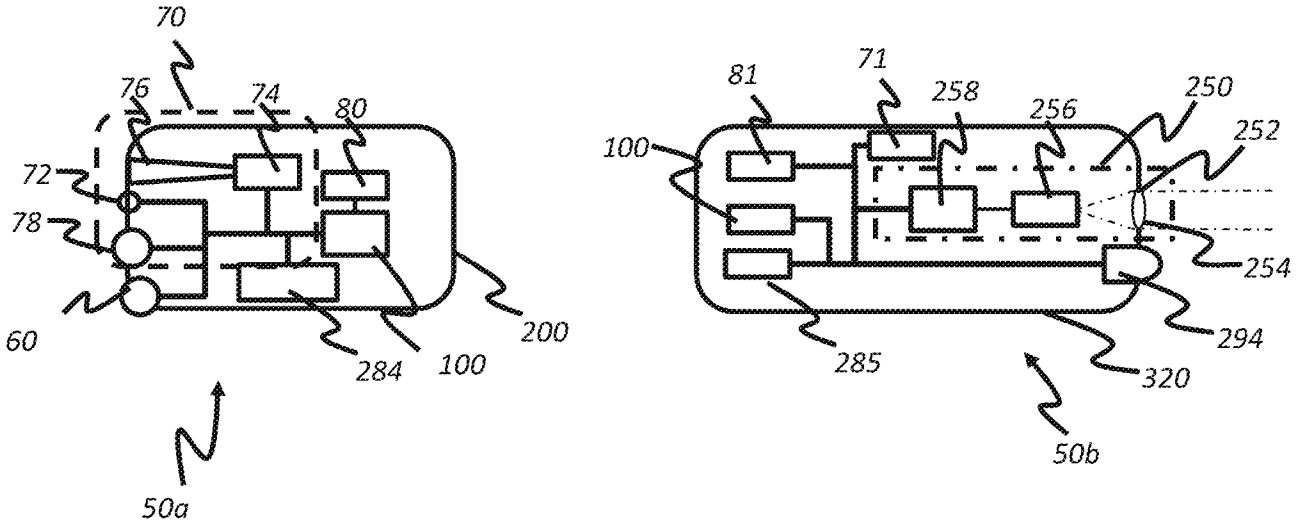
FIG. 17 is a schematic view of an embodiment of the deterrent device communication apparatus of FIG. 16.

In an alternative embodiment, illustrated in a front side isometric view in FIG. 16 and in a schematic view in FIG. 17, components of deterrent device communication apparatus are in the form of two modules shown here as 50*a* and 50*b* which are located in separated housings such as housing 200 and housing 306 on deterrent device 20. In this embodiment, for example, image capture system 250 an optional light emitter 294 and optional power supply 285 can be located in housing 320 of module 50*b* while activation sensor 60 and other components of deterrent device communication apparatus 50 are located in housing 200 of module 50*a*. Data or other signals can be shared between those components in module 50*a* and those components in module 50*b* by way of wired or wireless communications directly or by way of intermediate communication device 110. In this regard, module 50*b* can incorporate communication circuits 81 that can communicate with communication system 80 or with intermediate communication device 110, an interface system 71 that can for example sense audio signals, generate audio signals, and sense user input actions such as may be necessary to separately activate or deactivate module 50*a* or components thereof.

It will be appreciated from the foregoing that deterrent device communication apparatus, can have a size and can be positioned in ways that are not obtrusive and that do not interfere with normal operation and handling of deterrent device 20. For example, deterrent device communication system can have a total volume that is less than 9 cubic centimeters. Additionally, the system can be defined to have a power supply 248 such as battery that can be smaller than be for example smaller than about 4 cubic centimeters in volume.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted. Drawings herein may be to scale for particular embodiments; however, they are not necessarily to scale for all embodiments. The reference to singular elements such as for example and without limitation a "circuit" or a "fastener" will be understood to include one such element as well as combinations of more than one "circuit" or "fastener" unless stated otherwise.

The invention has been described in detail with particular reference to certain preferred embodiments thereof, but it will be understood that variations, combinations, and modifications can be effected by a person of ordinary skill in the art within the spirit and scope of the invention.

What is claimed is:

1. A device comprising:

a housing;

a communication apparatus disposed within the housing, the communication apparatus comprising:

an audio input circuit configured to sense sound in an environment external to the housing, and an audio output circuit configured to generate a human-perceptible sound, wherein at least one of the audio input circuit and the audio output circuit is operably connected to a controller; and a component configured to removably couple the housing to an apparatus configured to dispense a discharge.

2. The device of claim 1, wherein:

the apparatus comprises one of a handheld firearm, a chemical irritant disperser, a non-lethal projectile launcher, or a directed energy weapon.

3. The device of claim 1, wherein the controller is disposed within the housing.

4. The device of claim 1, further comprising an activation sensor operably connected to the controller and configured to detect when the device transitions from a first unused state to a second state, different from the first state, in which the device is ready for use.

5. The device of claim 4, wherein the activation sensor comprises a pressure sensor, a thermal sensor, a piezoelectric device, or a skin conduction sensor.

6. The device of claim 4, wherein the activation sensor is configured to:

detect that the apparatus is gripped by a user, and based at least in part on detecting that the apparatus is gripped, direct a signal to the controller indicating that the apparatus is gripped.

7. The device of claim 1, wherein the communication apparatus further comprises a transmitter operably connected to the controller and a receiver operably connected to the controller, the communication apparatus configured to exchange wireless communication signals with a communication intermediate, separate from the communication apparatus, via the transmitter and the receiver.

8. The device of claim 7, wherein the controller is configured to:

receive a first signal from an activation sensor associated with the apparatus, the first signal indicating that the apparatus has transitioned to a ready state, and based at least partly on the first signal:

cause the transmitter to emit a second signal indicating that the apparatus has transitioned to the ready state, and cause the receiver to begin actively sensing for one or more third signals from the communication intermediate.

9. The device of claim 8, wherein based at least partly on the first signal, the controller is further configured to:

cause the audio input circuit to sense a first sound in the environment, and cause the transmitter to direct a fourth signal, indicative of the first sound, to the communication intermediate.

10. The device of claim 7, wherein:

the transmitter is configured to send a first signal to the communication intermediate indicative of a first sound sensed by the audio input circuit in the environment;

the communication intermediate is configured to send a second signal to an emergency response center, based at least partly on the first signal, indicative of the first sound; and the communication intermediate is configured to send a third signal to the receiver indicative of a second sound sensed at the emergency response center.

11. The device of claim 1, further comprising an image capture system operably connected to the controller, the controller configured to cause the image capture system to capture at least one of a sequence of still images or a video stream based at least partly on receipt of a signal indicating that the apparatus is ready for use.

12. The device of claim 1, further comprising a power source, the power source configured to provide power to the communication apparatus for a time period of at least 30 minutes.

13. A method of manufacturing a device, the method comprising:

providing a housing;

disposing a communication apparatus within the housing, wherein the communication apparatus comprises an audio input circuit configured to sense sound in an environment external to the housing, and an audio output circuit operably connected to the controller and configured to generate a human-perceptible sound, wherein at least one of the audio input circuit and the audio output circuit is operably connected to a controller; and providing a component associated with the housing, the component configured to removably couple the housing to an apparatus configured to dispense a discharge.

14. The method of claim 13, further comprising operably connecting an activation sensor to the controller and linking the activation sensor to the apparatus, wherein the activation sensor is configured to detect when the apparatus is removed from a holder by sensing a change in electromagnetic signal proximate the apparatus.

15. The method of claim 13, further comprising:

operably connecting a transmitter of the communication apparatus to the controller; and operably connecting a receiver of the communication apparatus to the controller, the communication apparatus configured to exchange wireless communication signals with a communication intermediate, separate from the communication apparatus, via the transmitter and the receiver.

16. The method of claim 15, wherein:

the transmitter is configured to send a first signal to the communication intermediate indicative of a first sound sensed by the audio input circuit in the environment;

the communication intermediate is configured to send a second signal to a response center associated with law enforcement personnel, based at least partly on the first signal, indicative of the first sound; and the receiver is configured to receive a third signal from the communication intermediate indicative of a second sound sensed at the response center.

17. The method of claim 13, wherein the apparatus comprises one of a handheld firearm, a chemical irritant disperser, a non-lethal projectile launcher, or a directed energy weapon.

18. A device comprising:

a housing;

a communication apparatus disposed within the housing, wherein the communication apparatus comprises:

an audio input circuit configured to sense a first sound in an environment external to the housing, a transmitter configured to provide a first wireless signal to a remote response center via a communication intermediate separate from the communication apparatus, the first wireless signal indicative of the first sound, a receiver configured to receive a second signal from the remote response center via the communication intermediate, and an audio output circuit configured to generate a second human-perceptible sound based at least partly on the second signal, wherein at least one of the audio input circuit and the audio output circuit is operably connected to a controller; and a component configured to removably couple the housing to an apparatus configured to dispense a discharge.

19. The device of claim 18, wherein the device further comprises an activation sensor operably connected to the controller, wherein the activation sensor is configured to detect when the apparatus is removed from a holder by sensing a change in electromagnetic signal proximate the apparatus.

20. The device of claim 18, wherein the device further comprises a light source configured to emit a beam of radiation from the housing, the device further comprising at least one switch positioned on the housing and configured to activate the light source.

21. The device of claim 18, wherein the communication apparatus further comprises a directed sound concentrator configured to:

receive sound waves from the environment, concentrate the sound waves, and direct the concentrated sound waves to the audio input circuit.

22. The device of claim 18, wherein the controller is disposed within the housing.

23. The device of claim 18, wherein the apparatus comprises one of a handheld firearm, a chemical irritant disperser, a non-lethal projectile launcher, or a directed energy weapon.

* * * * *